US005881405A

United States Patent [19]

Garrigues

[11] Patent Number: 5,881,405

[45] Date of Patent: Mar. 16, 1999

[54] VENTILATED PERSONAL SHELTER

[75] Inventor: Gregory R. Garrigues, Bozeman, Mont.

[73] Assignee: K-2 Corporation, Vashon, Wash.

[21] Appl. No.: 908,874

[22] Filed: Aug. 8, 1997

[51] Int. Cl.[6] ..... A47G 9/08

[52] U.S. Cl. ..... 5/413 R; 5/414; 2/69.5; 135/96; 135/117

[58] Field of Search ..... 5/413 R, 413 AM, 5/414; 2/69.5; 635/93, 96, 117

[56] References Cited

U.S. PATENT DOCUMENTS

| | | | |
|---|---|---|---|
| 2,284,900 | 6/1942 | Henderson | 5/413 R |
| 4,531,330 | 7/1985 | Phillips | 5/414 |
| 4,787,105 | 11/1988 | Phillips et al. | 5/413 R |
| 4,894,878 | 1/1990 | Roach | 5/413 R |
| 5,386,602 | 2/1995 | Krenzler | 5/413 R |
| 5,669,088 | 9/1997 | McNames | 5/413 AM |

*Primary Examiner*—Michael F. Trettel
*Attorney, Agent, or Firm*—Christensen O'Connor Johnson & Kindness PLLC

[57] ABSTRACT

A personal shelter, such as a bivouac sack (10), tent or sleeping bag, for extracting internal moisture and venting. The personal shelter includes a top (14), bottom (12) and end (16) piece, and defines a foot end (17) and head end (18) at opposite ends of a longitudinal axis. The personal shelter also includes a first opening (40) at the foot end, a second opening (20) near the head end, and a semi-rigid duct (30) with an inlet end that is approximately colocated with the first opening and an outlet end that is approximately colocated with the second opening. The semi-rigid duct receives outside air through the first end, mixes the received outside air with moist air within the personal shelter, and exhausts the mixed air through the second end.

27 Claims, 6 Drawing Sheets

VENTILATED PERSONAL SHELTER

FIELD OF THE INVENTION

This invention relates to personal shelters and, more particularly, to improving the comfort of personal shelters.

BACKGROUND OF THE INVENTION

As will be understood from the following description, the present invention was developed for improving bivouac (hereinafter bivy) sacks. This invention may also find utility in other environments, such as tents and weather resistant sleeping bag shells.

Conventional bivy sacks are made from breathable materials that allow occupant produced moisture to escape while protecting the occupant from the environment, e.g., rain, snow, etc. However, an occupant tends to produce more moisture than what can escape through these breathable materials. Therefore, excess moisture accumulates within the bivy sack. On a foul weather day the occupant stores equipment and extra clothes within the bivy sack to keep them dry from the foul weather. This purpose is defeated when the accumulated moisture soaks the equipment and clothes.

A partial solution for improving the comfort in personal shelters is shown in the VL Wing tent produced by Mountain Hardwear. The VL Wing tent includes a square cross-sectioned, vertically hanging vent structure for promoting air flow within the tent. However, this vent structure is ineffective at decreasing moisture within the tent, because the tent fails to include coordinated vertical ventilation. The tent duct is oriented along an inverted V shaped path, having inlets to the outside air at the lowermost ends of the duct, and an outlet to the tent interior at the highest center point, i.e. at the apex of the tent. Because the warm, moist air inside the tent is less dense than the cold outside air, there is no mechanism to cause air to flow through the duct and outside. This design thus provides no effective mechanism for carrying moist air outside of the tent.

The present invention provides a new and improved personal shelter with improved moisture evacuation and ventilation.

SUMMARY OF THE INVENTION

In accordance with this invention, a personal shelter for evacuating internal moisture and venting is provided. The personal shelter includes a top, bottom and two ends at opposite ends of a longitudinal dimension of the personal shelter. The personal shelter also includes a first opening at the first end, a second opening at the second end and a semi-rigid duct with a first end that is approximately colocated with the first opening and a second end that is approximately colocated with the second opening. The semi-rigid duct receives outside air through the first end, mixes the received outside air with moist air within the personal shelter, and exhausts the mixed air through the second end.

In accordance with still other aspects of this invention, the duct is tapered from a smaller cross-section at the first end to a larger cross-section at the second end for promoting air flow from the first end to the second end. In accordance with a preferred embodiment of the present invention, the duct is semicircular in cross-section.

In accordance with further aspects of this invention, the duct is partially composed of a fabric which includes unidirectionally woven semi-rigid monofilament fibers. The monofilament fibers are positioned orthogonal to the longitudinal axis of the personal shelter. The monofilament fibers are bent into an arcuate conformation to form the semicircular cross-section of the duct.

The duct fabric is held in the semicircular form by a support material. The support material is a breathable fabric, preferably a brushed jersey knit mesh material that allows flow of moisture vapor therethrough and that also wicks condensed moisture into the duct.

In accordance with still yet further aspects of this invention, a fastenable flap is positioned at the first end for closing the first opening. A prop rod selectively holds the fastenable flap in an open position, thereby allowing air flow through the first opening.

As will be readily appreciate from the foregoing summary, the invention provides a personal shelter with new and improved moisture and air ventilation. The present invention is suitable for use in bivouac sacks, tents and environmentally shielded sleeping bags.

BRIEF DESCRIPTION OF THE DRAWINGS

The foregoing aspects and many of the attendant advantages of this invention will become better understood by reference to the following detailed description, when taken in conjunction with the accompanying drawings, wherein.

DETAILED DESCRIPTION OF THE PREFERRED EMBODIMENT

Figure 1:
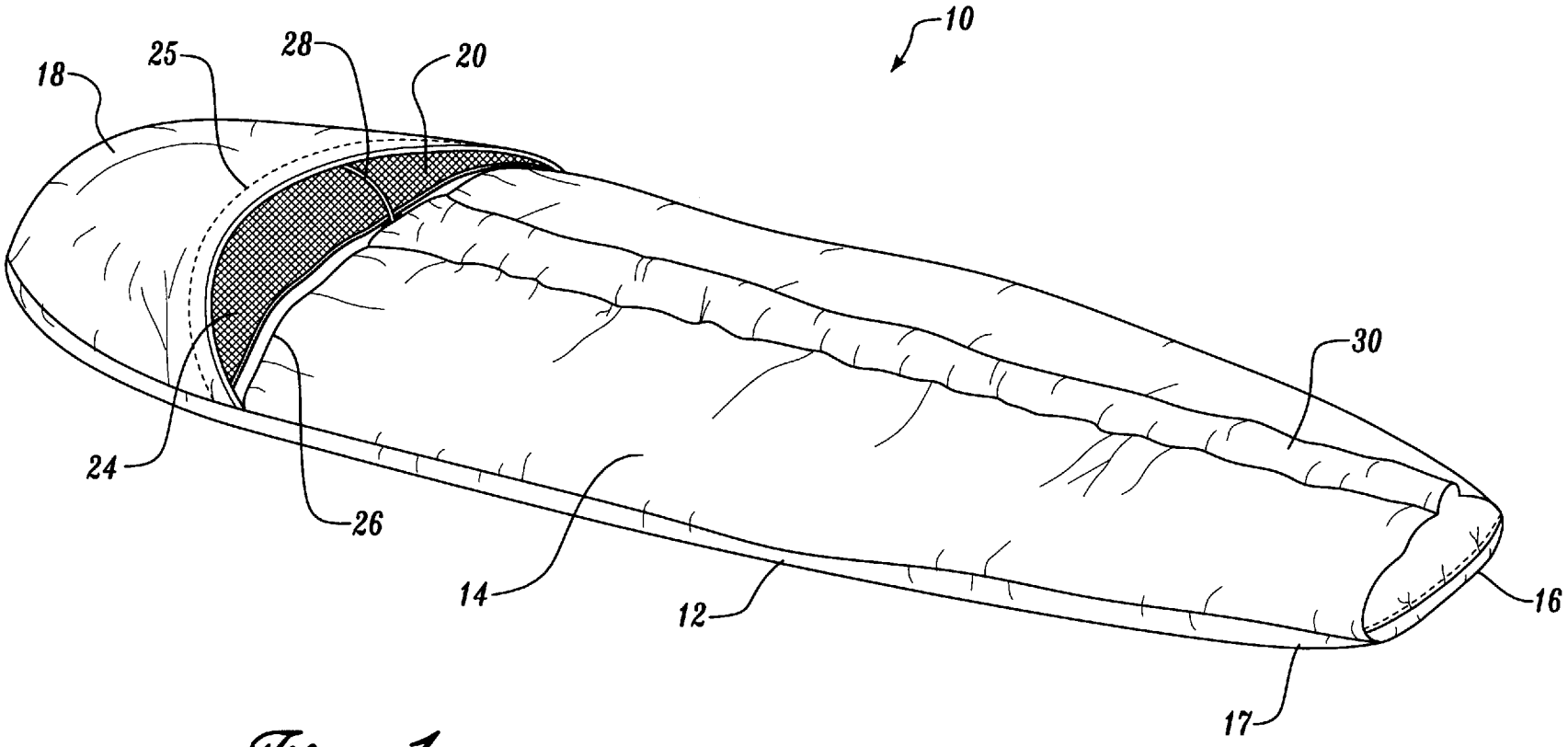
FIG. 1 is a perspective view of a bivouac sack formed in accordance with the present invention.

The present invention is a personal shelter with improved venting and moisture extracting qualities. FIG. 1 illustrates a bivouac (hereinafter "bivy") sack 10 type of personal shelter that is constructed in accordance with the present invention for improving ventilation and controlling moisture within. The bivy sack 10 includes a bottom piece 12 attached to a top piece 14 and an end piece 16. The top, bottom and end pieces form an elongate bag with a foot end 17 and a wider head end 18. Located near the head end 18 is a head opening 20. The head opening 20 spans approximately the width of the top piece 14. The head opening 20 is defined by first and second adjoining edges of the top piece 14. A first edge is part of the top piece 14 that extends to the head end 18 of the bivy sack 10, and a second edge is part of the top piece 14 that extends to the foot end 17. The bivy sack 10 also includes a central vent duct 30 and a foot vent 40, defined in the end piece 16, that are described in more detail below. The vent duct 30 extends from approximately the second edge of the head opening 20 to the end piece 16, along the central longitudinal axis of the top piece 14.

Figure 2:
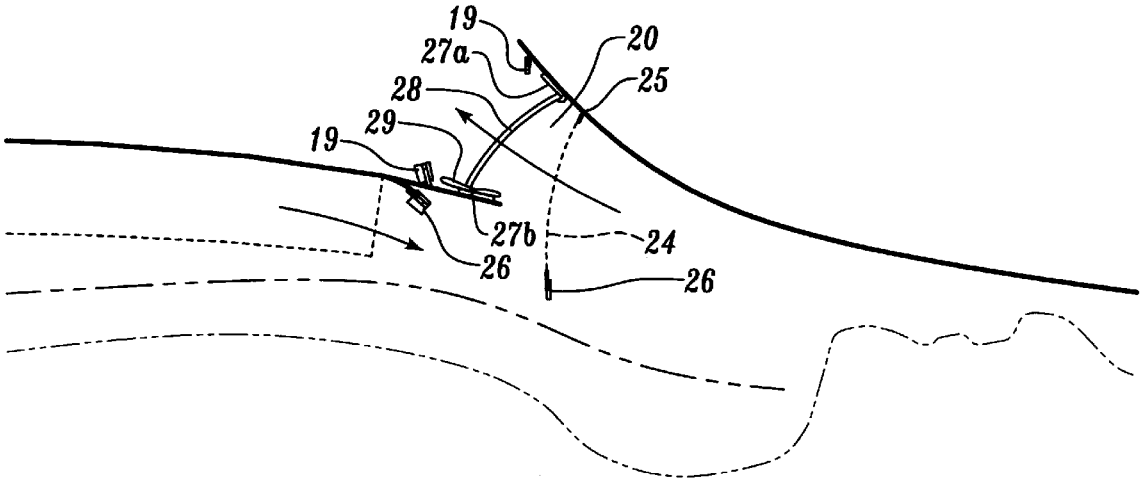
FIG. 2 is a side cross-sectional view of the main opening of the bivouac sack.

The head opening 20 is adjacent and spaced longitudinally from the extreme tip of the head end 18, so that it aligns generally with an occupant's shoulders. As shown in FIG. 2, the first and second edges defining the head opening 20 are selectively attachable by a fastener 19, such as a zipper, for attaching the edges and closing the head opening 20. One part of the fastener 19 is attached to the top side of the second edge, and the other part is attached to the bottom side of the first edge. The opening 20 permits entry and exit of a sleeping bag and occupant within the bivy sack 10.

The first edge of the opening 20 is also attachable to the second edge of the opening 20 by a hook and loop fastener pair 27*a* and *b*. Fastener 27*a* of the hook and loop fastener pair 27*a* and *b* is secured to the underside of the first edge. The other fastener 27*b* of the hook and loop fastener pair 27*a* and *b* is secured to the top side of the second edge. Attached at the underside of the first edge, approximately colocated with the fastener 27*a*, is one end of a prop rod 28. At the other end of the prop rod 28 is attached a fastener 29 that is attachable to fastener 27*b*. The prop rod 28 is a light, rigid or semi-rigid material, such as DELRIN™ polyamide, and is of a length sufficient for propping open the head opening 20 for ventilation and viewing. The fastener 27*a* can be selectively mated with the fastener 27*b* to close the head opening 20, or with the fastener 29 on the prop rod 28 to open the head opening 20.

Spanning the head opening 20 is a mesh screen 24 that is secured to the underside of the top piece 14, at a position 25 which is forwardly offset from the first edge of the opening 20. The mesh screen 24 is removably attached to a position underneath and rearwardly offset from the second edge by a fastener 26, such as a zipper.

The bottom piece 12 of the bivy sack 10 is preferably a water resistant material, such as a polyurethane coated nylon taffeta, and spans the underside of a sleeping bag clad occupant. The top and end pieces 14 and 16 surround the remainder of the occupant, and are preferably made of a waterproof hydrophilic laminate, such as ByroTex™, or other breathable, water-resistant fabric. The bottom piece 12, the top piece 14 and end piece are stitched together and sealed.

Figure 3:
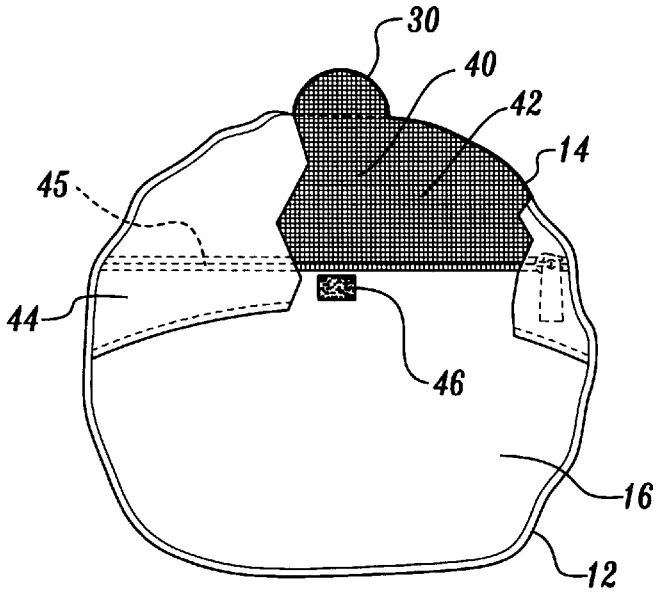
FIG. 3 is an end view of the foot of the bivouac sack.

FIG. 3 illustrates an end view of the bivy sack 10 looking at the foot end 17. The foot end 17 includes a foot vent 40 that is defined by edges of the top piece 14 and end piece 16. The foot vent 40 allows stagnant air within the foot end 17 of the bivy sack 10 to escape and fresher outside air to enter. The foot vent 40's height is approximately a third of the end piece's height. Thus the end piece 16 rises approximately two-thirds of the height of the foot end 17, terminating to define the foot vent 40 opening. A mesh screen 42 is securably attached, such as by stitching, to the underside of the top and end piece edges that define the foot vent 40. A foot vent cover 44 is attached to the top piece 14 edge that defines the foot vent 40. The foot vent cover 44 extends to approximately the location where the top and bottom piece 12 and 14 meet, thereby producing an inverted pocket. The foot vent cover 44 extends below the end piece 16 edge that defines the foot vent 40. The foot vent cover 44 is preferably made of a waterproof hydrophilic laminate, such as ByroTex™, or other breathable, water-resistant fabric. A fastener 45, such as a zipper, is attached along the edge of the end piece 16 that defines the foot vent 40, and is attached to the underside of the foot vent cover 44 offset from the foot vent cover 44's bottom edge. When the fastener 45 is fully secured, the foot vent 40 is fully covered by the foot vent cover 44. When the fastener 45 is opened, the screened foot vent 40 is exposed for ventilation.

Figure 4:
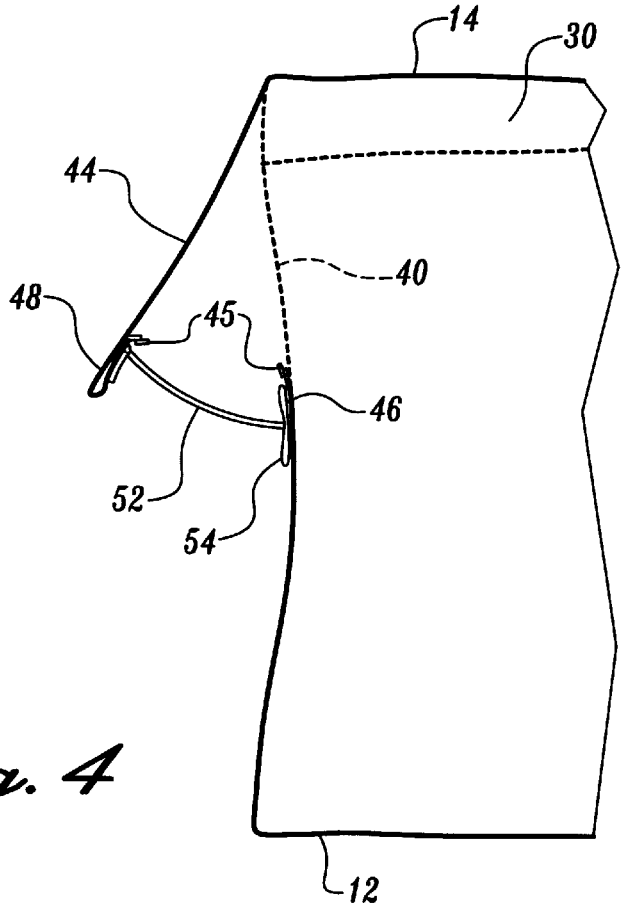
FIG. 4 is a side cross-sectional view of the foot end of the bivouac sack.

As shown in FIG. 4, the foot vent cover 44 is also attachable to the end piece 16 by at least one hook and loop fastener pair 46 and 48. Fastener 46 of the hook and loop fastener pair 46 and 48 is secured to the end piece 16 below the edge that defines the foot vent 40. The other fastener 48 of the hook and loop fastener pair 46 and 48 is secured to the underside of the foot vent cover 44 between the foot vent cover 44's bottom edge and the fastener 45. The hook and loop fasteners 46 and 48 provide additional securing of foot vent cover 44 to the end piece 16, but can also be attached separately for providing less than full blockage of the foot vent 40.

Attached at the underside of the foot vent cover 44, approximately colocated with the fastener 48, is one end of a rigid or semi-rigid prop rod 52. At the other end of the prop rod 52 is attached a hook and loop fastener 54 that is selectively attachable to the fastener 46. The prop rod 52 is suitably constructed from DELRIN™ or other rigid or semi-rigid material, and is of a length that provides separation between the bottom edge of the foot vent cover 44 and end piece 16, to provide a significant opening for air to pass into or out of the screened foot vent 40.

Located just inside the foot vent 40 at the top of the top piece 14 is the intake end of the vent duct 30. The vent duct 30 extends longitudinally along the centerline crest of the top piece 14, to the head opening 20. The vent duct 30 is a semi-rigid construction for receiving air through the foot vent 40 when the foot vent cover 44 is fully or partially open.

Figure 5:
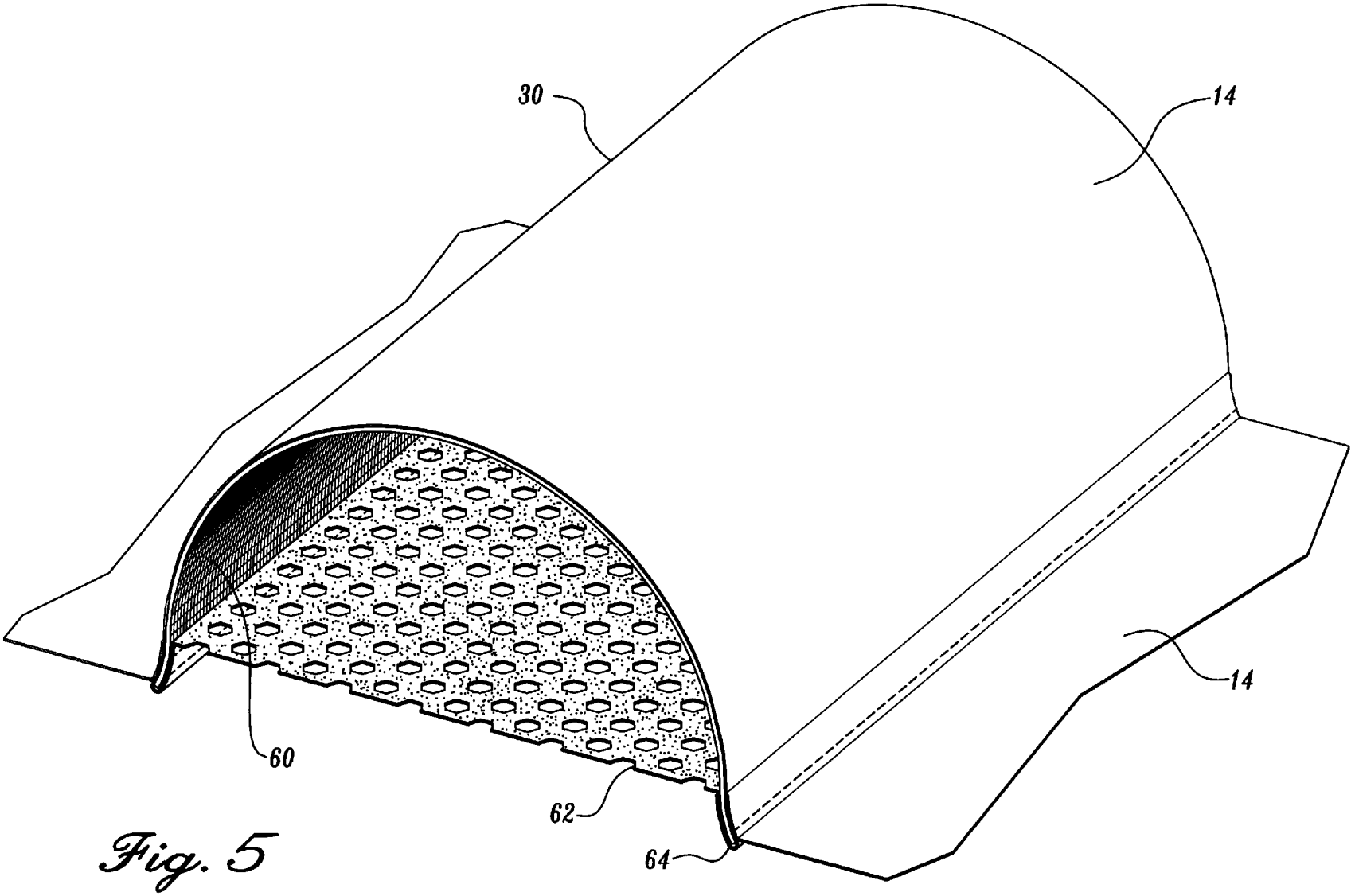
FIG. 5 is a perspective cross-sectional view of a vent duct used in the bivouac sack.
Figure 6:
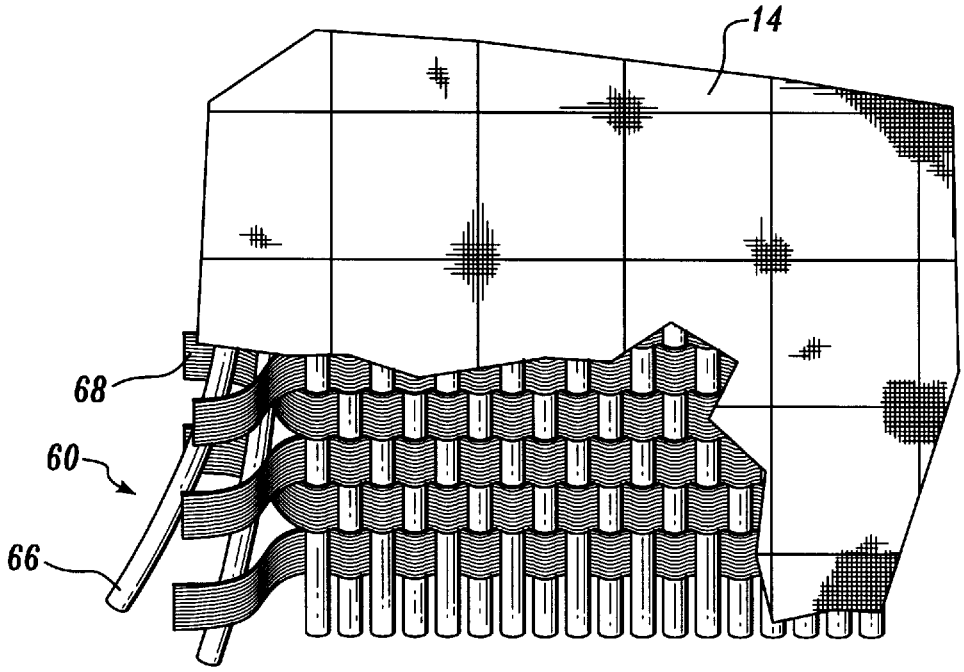
FIG. 6 is a detailed view of the monofilament vent duct material.

FIG. 5 is a perspective cross-sectional view of the vent duct 30. The vent duct 30 is a semi-rigid, semi-circular structure that includes a semi-circular inner wall 60 and a support material 62 attached to the longitudinal edges of inner wall 60 by sewn strips of bias tape 64. The inner wall 60 and support material 62 each form a longitudinal portion or segment of the wall of the vent duct 30. The top piece 14 overlies and wraps the exterior of the inner wall 60. The inner wall 60 is bent arcuately in the transverse direction, defining a semicircular cross-sectioned longitudinal duct. The longitudinal edges of the inner wall 60 are spanned by the support material 62 to complete the vent duct 30. The bias-tape wrapped longitudinal edges of the inner wall 60 are sewn to the top piece 14. As shown in FIG. 6, inner wall 60 is a unidirectional semi-rigid material woven from a fill 66 and a warp 68. The fill 66 is preferably a resilient monofilament polyethylene extrusion, or other semi-rigid material. The monofilament fibers define a semi-rigid skeleton that maintains the duct 30 open. The warp 68 is a conventional flexible fiber, such as nylon.

In order for the duct 30 to be properly formed, the inner wall 60 is positioned so that the fill 66 is transversely oriented, i.e., orthogonal to the longitudinal axis of the duct 30. The width of the support material 62 is approximately two-thirds the width of the inner wall 60, and thus the semi-rigid fill 66 resiliently flexes under the tension produced by the smaller support material 62. This construction produces a duct that is semi-rigid in the direction orthogonal to the longitudinal axis, and yet which is compressible along the longitudinal axis. When unfolded for use, the inner wall 60 ensures that the vent duct 30 is biased open fully along its length, from the foot vent 40 to the head opening 20. Yet for storage within a stuff sack, the bivy sack 10 is longitudinally nearly as compressible as a similar bivy sack without a vent duct.

The support material 62 is preferably a breathable and moisture-wickable material, such as a perforated brushed jersey knit material. This material allows moisture laden air from the occupant of the bivy sack 10 to pass through numerous ventilation apertures formed in an array through the support material 62, into the cavity formed by the flexed inner wall 60. Also, the support material 62 wicks any moisture that condenses on the support material 62 from inside the bivy sack into the vent duct 30, thereby giving the moisture a greater ability to evaporate and subsequently pass out of the bivy sack 10 in a vaporous state.

Figure 7A:
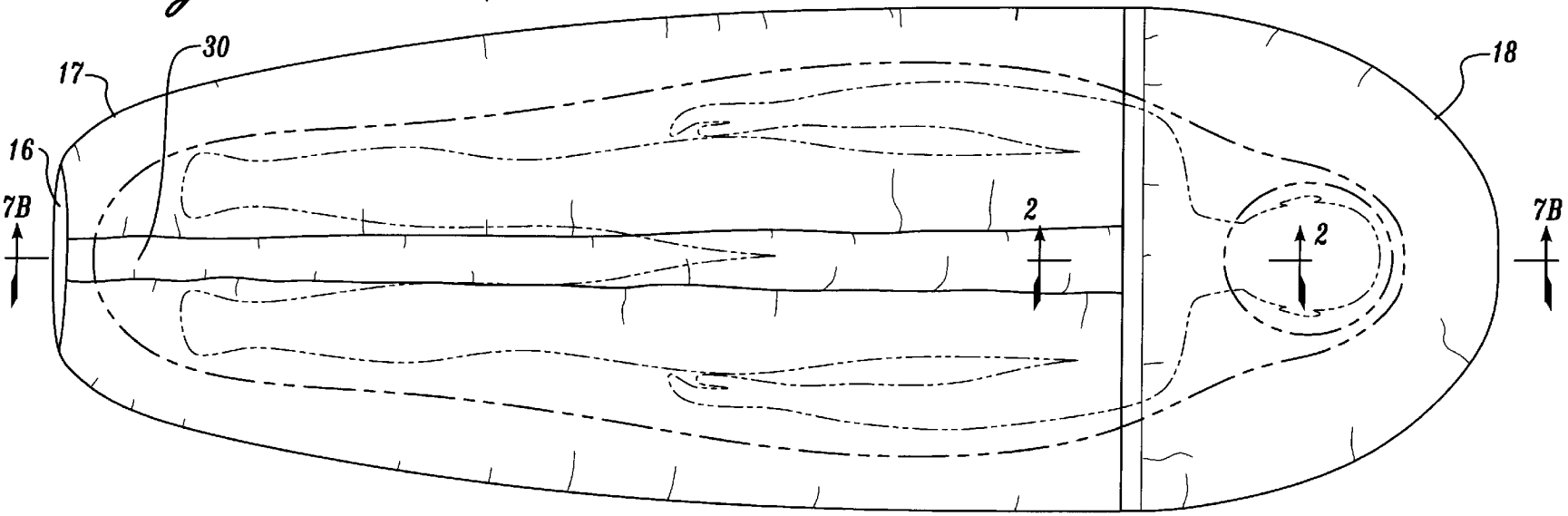
FIG. 7A is a top view of an occupied bivouac sack of the present invention.
Figure 7B:
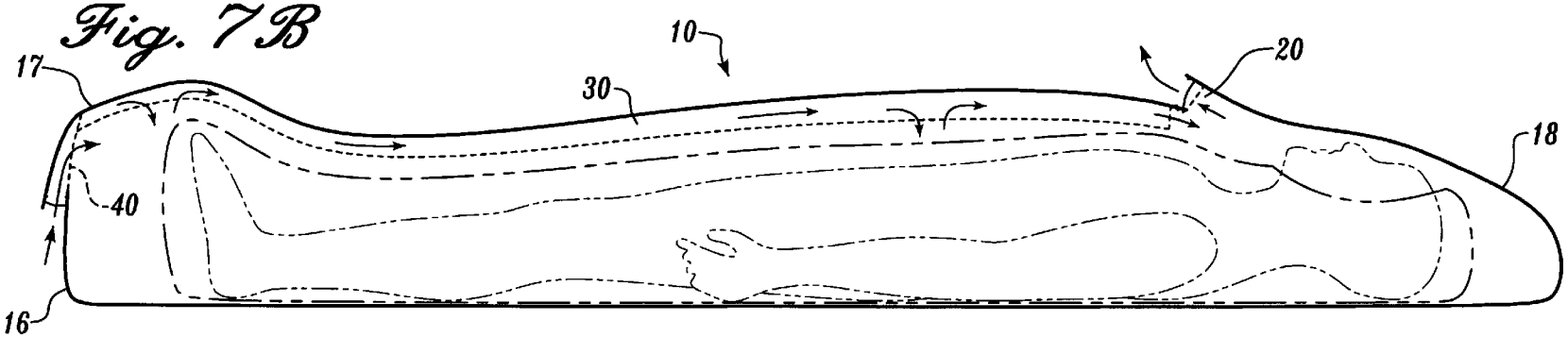
FIG. 7B is a side cross-sectional view of an occupied bivouac sack of the present invention.

As shown in FIGS. 1, 7A and 7B, the width or diameter of the vent duct 30 increases as it extends from the foot vent 40 to the head opening 20. This tapering of the vent duct 30 promotes the movement of air from outside the bivy sack 10 through foot vent 40, into and through vent duct 30, and out the head opening 20. Selective opening and closing of the foot vent 40 and head opening 20 allows control of the rate of air flow through vent duct 30. Because outside air is drier and colder than air trapped inside the bivy sack 10, the drier outside air draws the moister air from within the interior of the bivy sack 10 through the support material 62. As the mixed air flows forwardly and slightly upwardly through the vent duct 30, it warms, expands, and evaporates any moisture clinging to the support material 60 or the inner wall 62 of the vent duct 30. The expansion of air as it warms creates and maintains an airflow through the vent duct 30.

It will be readily appreciated by those of ordinary skill in the art that the present invention has a number of advantages. The foot vent 40 allows stagnant air within the personal shelter to be exchanged for fresher air. The vent duct 30 allows cooler, dryer air to flow through the personal shelter, extracting moist stagnant air from within the personal shelter, thereby keeping the occupant dry and comfortable.

The present invention has thus far been described in terms of the bivy sack 10. However, the present invention may be readily adapted by one of ordinary skill in the art for use in other types of personal shelters. For example, the semi-rigid vent duct 30 of the present invention could be sewn into the wall of a tent (not shown), for airflow from a low inlet vent to a higher outlet vent. As a further example, the vent duct 30 of the present invention could also be sewn into the interior of an environmentally sheltered sleeping bag (not shown), e.g., a sleeping bag that includes a breathable, water-resistant outershell and that thus may be used by an occupant without the necessity of a bivy sack.

As a further example, the duct 30 of the present invention may be alternately constructed to that described above. For example, the entire duct 30 could be sewn from the semi-rigid, monofilament fiber fabric, to define a circular or other geometric cross-sectioned duct. However, while the monofilament fiber fabric is breathable, air flow into and out of the duct along its length would be limited relative to the preferred embodiment of the present invention. Other vent duct 30 constructions are possible, such as a duct defined by a spiral semi-rigid monofilament surrounded by breathable fabric (not shown) or a triangular cross-sectional duct (not shown).

While the preferred embodiment of the invention has been illustrated and described, it will be appreciated that these and various other changes can be made therein without departing from the spirit and scope of the invention.

The embodiments of the invention in which an exclusive property or privilege is claimed are defined as follows:

1. A personal shelter with improved moisture and air venting, comprising:

a shell having a top surface and a bottom surface, and defining a longitudinal axis and first and second ends;

a first opening defined in the shell in proximity to the first end of the personal shelter;

a second opening defined in the shell spaced longitudinally from the first opening; and an at least partially semi-rigid duct secured to the interior of the shell that extends from the first to the second opening for receiving outside air through the first opening, mixing the received outside air with air from within the personal shelter, and exhausting the mixed air through the second opening.

2. The personal shelter of claim 1, wherein a cross-sectional profile of the duct is tapered from a larger cross-section at the second opening to a smaller cross-section at the first opening for promoting air flow through the duct from the first opening to the second opening.

3. The personal shelter of claim 1, wherein the duct defines a semicircular cross-section.

4. The personal shelter of claim 1, wherein the duct comprises a fabric including semi-rigid members.

5. The personal shelter of claim 1, wherein the semi-rigid members comprise monofilament fibers.

6. The personal shelter of claim 5, wherein the monofilament fibers are oriented orthogonally to the longitudinal axis of the personal shelter.

7. The personal shelter of claim 6, wherein the duct is compressible in the longitudinal direction.

8. The personal shelter of the claim 6, wherein the duct further comprises a breathable support material.

9. The personal shelter of the claim 8, wherein the support material comprises a perforated fabric.

10. The personal shelter of the claim 9, wherein the perforated fabric is a wickable fabric.

11. The personal shelter of claim 8, wherein the monofilament fiber fabric defines an arcuate wall portion of the duct that is maintained in an open configuration by a supporting wall portion defined by the support material.

12. The personal shelter of claim 11, wherein the arcuate wall is resiliently loaded in the arcuate configuration.

13. The personal shelter of claim 12, wherein the breathable support material is disposed to face inwardly towards an interior of the personal shelter.

14. The personal shelter of claim 1, further comprising a fastenable flap at the first end, wherein the flap is selectively fastenable for blocking the first opening.

15. The personal shelter of the claim 14, further comprising a prop rod secured to the personal shelter adjacent to the fastenable flap for holding the fastenable flap in an open position, thereby allowing air flow through the first opening.

16. The personal shelter of claim 1, wherein the shell is configured as a bivouac sack.

17. The personal shelter of claim 16, wherein the first opening is disposed in proximity to a foot end of the bivouac sack, and the second opening is disposed in proximity to a head end of the bivouac sack.

18. The personal shelter of claim 17, wherein the duct runs along a central longitudinal apex of the top surface of the bivouac sack.

19. A ventilated personal shelter, comprising:

a shell defining an upper surface, a lower surface and an enclosed interior, and further defining a first ventilation opening to the exterior and a second ventilation opening to the exterior spaced apart and elevated above the first ventilation opening; and a duct secured to an inner side of the upper-surface, the duct defining a first end in airflow communication with the first ventilation opening and a second end in airflow communication with the second ventilation opening, and defining airflow apertures disposed between the first and second ends for air exchange between the duct and the enclosed interior.

20. The personal shelter of claim 19, wherein the shell is configured as an elongate bivouac sack, and the first and second ventilation openings are disposed at a foot end and a head end of the bivouac sack, the duct spanning longitudinally therebetween.

21. The personal shelter of claim 19, wherein the duct comprises a wall material and a semi-rigid reinforcing skeleton for maintaining the wall material in an open configuration.

22. The personal shelter of claim 21, wherein the semi-rigid reinforcing skeleton comprises a plurality of semi-rigid members disposed transversely relative to a longitudinal axis of the duct.

23. The personal shelter of claim 22, wherein the semi-rigid members are woven into a first portion of the wall of the duct.

24. The personal shelter of claim 23, wherein the wall of the duct further comprises a second portion defining the airflow apertures.

25. The personal shelter of claim 24, wherein the first and second portions of the wall define an outer and an inner longitudinal wall segments of the duct, respectively.

26. The personal shelter of claim 25, wherein the semi-rigid members in the first portion of the wall are maintained in a resiliently bent configuration by the second portion of the wall.

27. A ventilated bivouac sack, comprising:

a water-resistant shell defining a lower surface, an upper surface, an enclosed interior, a foot and a head end, the shell further defining:

an access opening adjacent the head end for entry and exit into the interior of the shell;

a ventilation opening disposed in the foot end of the shell;

a fastener secured to the shell for selectively opening and closing the ventilation opening; and an airflow channel defined along the shell for placing the access opening in air flow communication with the ventilation opening, wherein the air flow channel comprises a frame for allowing air to flow between the access opening and the ventilation opening.

* * * * *